US009574539B2

(12) United States Patent
Lenz et al.

(10) Patent No.: US 9,574,539 B2
(45) Date of Patent: Feb. 21, 2017

(54) IGNITION METHOD FOR AN INTERNAL COMBUSTION ENGINE AND AN IGNITION DEVICE OPERATED ACCORDINGLY

(71) Applicant: PRUEFREX engineering e motion GmbH & Co. KG, Cadolzburg (DE)

(72) Inventors: Denis Lenz, Fuerth (DE); Leo Kiessling, Cadolzburg (DE)

(73) Assignee: PRUEFREX engineering e motion GmbH & Co. KG, Cadolzburg (DE)

( * ) Notice: Subject to any disclaimer, the term of this patent is extended or adjusted under 35 U.S.C. 154(b) by 224 days.

(21) Appl. No.: 14/068,880

(22) Filed: Oct. 31, 2013

(65) Prior Publication Data

US 2014/0137846 A1 May 22, 2014

(30) Foreign Application Priority Data

Oct. 31, 2012 (DE) ..... 10 2012 021 325
Nov. 6, 2012 (DE) ..... 10 2012 021 609

(51) Int. Cl.
*F02P 9/00* (2006.01)
*F02P 11/02* (2006.01)
(Continued)

(52) U.S. Cl.
CPC ..... *F02P 9/00* (2013.01); *F02N 11/087* (2013.01); *F02N 11/0866* (2013.01);
(Continued)

(58) Field of Classification Search
CPC ..... F02P 9/00; F02P 1/086; F02P 11/02; F02P 3/0884; F02P 3/0807; F02P 11/025; F02P 1/08; F02N 11/087; F02N 2011/0881; F02N 2011/0874; F02N 2011/0896; F02N 11/0866
(Continued)

(56) References Cited

U.S. PATENT DOCUMENTS 4,305,004 A * 12/1981 Tanaka ..... F02P 15/12 307/10.6
4,462,356 A * 7/1984 Hirt ..... 123/335
(Continued)

FOREIGN PATENT DOCUMENTS

CN 2031448 U 1/1989
CN 1062580 A 7/1992
(Continued)

OTHER PUBLICATIONS

Chinese First Office Action for Application No. 201310532672.2 dated Aug. 31, 2015—English translation.

*Primary Examiner* — Stephen K Cronin
*Assistant Examiner* — Susan E Scharpf
(74) *Attorney, Agent, or Firm* — Muncy, Geissler, Olds & Lowe, P.C.

(57) ABSTRACT

The detection of the switching state of a stop switch at a switch terminal of an ignition device for an internal combustion engine is provided, in which an ignition pulse for controlling an electronic ignition switch is generated and a first power storage device is discharged via an ignition coil and during this discharge a voltage signal having negative and positive voltage half waves is generated, which is used for synchronizing a sampling, representing the switch state of the stop switch, particularly its closed position, of a voltage value at the switch terminal.

15 Claims, 6 Drawing Sheets

(51) Int. Cl.
*F02N 11/08* (2006.01)
*F02P 1/08* (2006.01)

(52) U.S. Cl.
CPC ..... *F02P 1/086* (2013.01); *F02P 11/02* (2013.01); *F02N 2011/0874* (2013.01); *F02N 2011/0881* (2013.01); *F02N 2011/0896* (2013.01); *F02P 1/08* (2013.01)

(58) Field of Classification Search
USPC ..... 123/664, 599, 600, 601, 630, 632,123/198 DC, 143 B, 406.56; 701/112, 113; 361/139, 265; 307/10.6; 324/415–423
See application file for complete search history.

(56) References Cited

U.S. PATENT DOCUMENTS 4,515,118 A * 5/1985 Haubner et al. ..... 123/406.56
5,531,206 A 7/1996 Kitson et al.
5,903,063 A * 5/1999 Blaker ..... H02J 7/0063 307/10.1
6,188,224 B1 * 2/2001 Hannoyer et al. ..... 324/380
6,701,896 B2 * 3/2004 Kiessling ..... 123/406.57
7,156,075 B2 * 1/2007 Kiessling ..... F02P 9/002 123/406.56
7,362,011 B2 * 4/2008 Komatsu et al. ..... 307/137
7,410,563 B2 * 8/2008 Komatsu et al. ..... 205/725
7,518,261 B2 * 4/2009 Sugimura ..... G01R 31/3278 307/10.6
7,550,878 B2 * 6/2009 Komatsu et al. ..... 307/137
7,683,642 B2 * 3/2010 Martin et al. ..... 324/691
8,032,292 B2 10/2011 Kiessling et al.
8,513,953 B2 * 8/2013 Myoen ..... H02H 9/001 180/443
2011/0162615 A1 7/2011 Dauster et al.
2012/0032506 A1 * 2/2012 Cawthorne ..... F02N 11/0866 307/10.6
2012/0140364 A1 * 6/2012 Kato ..... B60W 50/0205 361/23

FOREIGN PATENT DOCUMENTS

DE 102 32 756 A1 6/2003
DE 10 2004 059 070 A1 2/2006
DE 197 36 032 B4 12/2006
EP 2 020 502 A1 2/2009
EP 2 330 606 A1 6/2011

* cited by examiner

IGNITION METHOD FOR AN INTERNAL COMBUSTION ENGINE AND AN IGNITION DEVICE OPERATED ACCORDINGLY

This nonprovisional application claims priority to German Patent Application No. DE 10 2012 021 325.5, which was filed in Germany on Oct. 31, 2012, and to German Patent Application No. DE 10 2012 021 609.2, which was filed in Germany on Nov. 6, 2012, and which are both herein incorporated by reference.

BACKGROUND OF THE INVENTION

Field of the Invention

The present invention relates to a method for detecting the switching state of a stop switch at a switch terminal of an ignition device for an internal combustion engine and an ignition device operating accordingly.

Description of the Background Art

It is basically known from DE 197 36 032 B4 and DE 10 2004 059 070 A1 to provide an ignition module or a magnetic ignition circuit (magnetic ignition circuit or condenser ignition device) with an external stop switch. The stop switch acts on power electronics (control unit) and in the closed state prevents the generation of an ignition spark.

In a method disclosed in EP 2 330 606 A1, a voltage pulse or a voltage signal is applied at a stop connection for the stop switch of a magnetic ignition circuit for the purpose of cleaning the contacts of the stop switch. The appropriate voltage pulse is generated by rectifying a voltage signal, which arises during the discharge of a power storage device. It is also known from this patent to use a medium voltage pulse concurrently as a stop switch sampling or for evaluating the state of the stop switch, i.e., whether its switch contacts are open or closed. For this purpose, a digital controller of the known magnetic ignition system can measure the voltage at the stop switch during the medium voltage pulse, and the opened state of the stop switch can be inferred if a specific level or a voltage value predetermined for the controller for a voltage comparison is exceeded, whereas a closed state of the stop switch can be inferred when values fall below the level or the predetermined voltage value.

SUMMARY OF THE INVENTION

It is therefore an object of the present invention to provide an especially suitable method for operating an ignition device, particularly for detecting the switching state, particularly the closed state, of a stop switch at a switch terminal of an ignition device for an internal combustion engine. Further, an ignition device operating according to this method is to be provided.

During operation of an ignition device for an internal combustion engine, an ignition pulse for controlling an electronic ignition switch is generated and discharged via an ignition coil of a (first) power storage device in the form of an ignition capacitor, which is charged or has been charged by means of a charging coil coupled to a magnetic generator. Depending on the rotary position of the magnetic generator coupled to the internal combustion engine, this generates a temporal charging voltage profile, also called a voltage signal below, with alternating negative and positive voltage half waves.

To detect the switching state of a stop switch at a switch terminal (stop terminal) of the ignition device, a voltage signal with negative and positive voltage half waves is generated advantageously during the discharge of the (first) power storage device. This is used expediently for synchronizing a sampling, particularly of a voltage level or voltage value. Preferably, the voltage signal is used for synchronizing a sampling (stop sampling) representing the switch state, particularly the closed state, at the switch terminal. For this purpose, a second power storage device connected to the switch terminal is suitably charged to a voltage value. The charging of said power storage device again expediently in the form of a capacitor occurs particularly in time before the stop sampling.

The invention is based on the realization that in the case of a number of tests or samplings of the switch state of the stop switch (stop samplings) as well, an actuation of the stop switch and particularly its actual closed state are not reliably determined with a certain probability, even if a certain number of voltage drops or values below a certain level are detected by a control unit, particularly in the form of a microcontroller. Thus, theoretical observations of signal curves in oxidized switch contacts have shown that prior concepts or methods of the stop sampling can be encumbered by a residual error.

The invention now proceeds from the consideration that a reliable conclusion on the switching state of the stop switch, particularly its closed state, can be drawn without the likelihood of residual errors, if the stop sampling or stop test is run only when a sufficiently high current flow through the stop switch is assured. Such a current flow with a relatively high current value reliably leads to a cleaning of the switch contacts of the stop switch and particularly to a reliable burning off of oxidations or other impurities. Such a current flow with a high current value occurs again, when the positive voltage half waves, at least the first positive half wave of a voltage signal, are used, said voltage signal which can be tapped during the generation of an ignition spark (sparkover) at a (first) power storage device. Said voltage signal with positive and negative voltage half waves arises during the controlling of an electronic ignition switch, as a result of which the (first) power storage device or ignition capacitor is discharged via this switch and the primary winding of an ignition transformer, also frequently called an ignition coil.

This signal can be an alternating voltage signal with an amplitude, declining over time, of the positive and negative voltage half waves. At first a negative voltage half wave follows in time after the ignition or control pulse for the electronic ignition switch. The positive half wave following thereupon is supplied to the switch terminal and is used there for generating a current flow with a relatively high current strength via the stop switch, when its switch contacts are securely closed. Such a current flow is absent when the stop switch is opened.

If therefore the stop sampling is made during such a relatively high current flow through the stop switch, then it can be safely assumed that the stop switch has been actuated in the closed position and its switch contacts contact reliably. This high current flow comes about again, when the (first) positive voltage half wave of the voltage signal during the spark generation or during the sparkover for the burn-off (cleaning) of the switch contacts of the stop switch is conducted across these.

To assure or support this high current flow, preferably a (second) power storage device (charging or terminal capacitor), connected to the switch terminal of the ignition device, is charged. Its state of charge is reached before the ignition pulse for controlling the ignition switch is generated. In other words, this (second) power storage device is charged preferably only shortly before the spark triggering, e.g., a specific time period after the generation of the control or ignition pulse for the electronic ignition switch or semiconductor switch.

A sampling of the state of charge or voltage value at the switch terminal reliably provides information on whether the stop switch has been actuated in the direction of the closed position. If particularly at the time when the voltage signal preferably leads to the first positive voltage half wave, the state of charge of the power storage device at the switch terminal or the voltage value of said terminal is sampled, then at least significant voltage variations of a voltage signal or voltage level analyzed and tapped at the switch terminal are not present when the stop switch is closed and its switch contacts are cleaned.

In contrast, voltage variations can arise at the switch terminal and accordingly be present in the appropriately sampled voltage signal, when the voltage signal or the voltage value at the switch terminal is sampled at another time and/or the stop switch is opened, and as a result of contaminations (oxidations) of the switch contacts brief arc-overs between the switch contacts occur or the stop switch operates in the closed position whose contacts however are not yet closed free of contaminants.

The voltage value at the switch terminal is preferably supplied to an input of a control unit, particularly to a microprocessor or microcontroller, of the ignition device and thereby provided particularly to a comparator or a comparator function. The comparator function can be realized by means of circuitry or expediently by programming by an appropriate algorithm and thus by software.

The comparator function is preferably only active when the first positive voltage half wave of the voltage signal occurs as a result of the control of the electronic ignition switch. The comparator function to this end is expediently synchronized with this voltage signal and thereby particularly with the time or with the time interval of the first positive voltage half wave. In other words, the voltage signal, particularly its first positive voltage half wave, is used for synchronizing the voltage sampling (stop sampling or stop test) at the switch terminal. At this synchronization time or interval, a power storage device (capacitor), preferably connected to the switch terminal, is charged, so that a sufficiently high energy is available for the desired high current flow across the closed stop switch and therefore for the cleaning of its contacts.

The control unit of the ignition device is therefore provided and configured in terms of circuitry and/or programs to charge said power storage device at the switch terminal, before the ignition pulse or a specific time interval before or after the ignition pulse has been generated by the control unit for controlling the electronic ignition switch. The control unit of the ignition device is moreover provided and configured by means of circuitry and/or programs to sample or scan the current voltage value at the switch terminal and to evaluate it with respect to the switch state of the stop switch.

To charge the power storage device at the control terminal the control unit has an output, which is run via a series resistor to the switch terminal or to a connection between it and an input of the control unit. This input, also called the comparator input hereinafter, of the control units supplies the voltage signal or the voltage value to the switch terminal. Alternatively, the connection between this input of the control unit and the switch terminal during connection of an ohmic resistor, which is used to reduce or divide down the voltage at the input of the control unit, can also be used for charging the power storage device at the switch terminal.

The control unit moreover has an input, called a synchronization input hereinafter, to which the (alternating) voltage signal, also called the synchronization signal hereinafter, with the negative and positive voltage half waves is supplied, which arises after the generation of the ignition pulse to control the electronic ignition switch and thus during spark generation. This voltage signal is expediently tapped between the first power storage device (ignition capacitor) and the primary winding of the ignition generator or optionally at a trigger coil and supplied as a synchronization signal to the control unit. Ignition devices with and without such a trigger coil are basically known, for example, from DE 102 32 756 A1 or from EP 2 020 502 A1, which are herein incorporated by reference.

According to an embodiment, in addition a sampling to detect the switching state of the stop switch at the switch terminal can occur during particularly the first positive voltage half wave of the charging coil signal, i.e., before the generation of the ignition spark and during the same rotation of the magnetic generator.

The switch state can be suitably inferred from a deviation of the sampled or scanned charging coil signal, particularly during its first positive voltage half wave, from a threshold value. In this case, the closed state or actuation of the stop switch in the closed position is expediently inferred or detected when the sampled or scanned charging coil signal falls below a threshold value. Similarly, an open state or no actuation of the stop switch is detected when the sampled charging coil signal exceeds the threshold value. The sampling or scanning of the charging coil signal occurs preferably with a number of scans and/or during a specific scanning time. A closed state or actuation of the stop switch in the closed position is detected, when a threshold undershooting is detected in a specific number of scans.

A sampling of this state of charge or the voltage value at the switch terminal provides information whether the stop switch has been actuated in the direction of the closed position. If particularly at the time when the charge voltage (charging coil signal) preferably supplies the first voltage half wave, the state of charge of the power storage device at the switch terminal or the voltage is sampled from it, thus voltage values above the threshold value are to be expected there when the stop switch is opened. This applies in particular also to the case that the stop switch is in fact actually opened, but because of contaminations at the switch contacts, a finite resistance of, e.g., a few kΩ at the switch terminal causes a voltage value that is greater or equal to the threshold value. In other words, this situation is also taken into account when the threshold value is predetermined. In contrast, voltage values below the threshold value are to be expected, when the stop switch is closed. This also applies when contaminants of the switch contacts again cause a specific resistance value (shunt), which, however, with, e.g., 50Ω is much lower than in the case of an opened stop switch.

The advantages achieved with the invention are particularly that a reliable measurement can be made by transferring the stop sampling (stop test) temporally into the range of spark formation of an ignition device for an internal combustion engine during the highest possible burn-off current for the contacts of a stop switch, without relevant disturbances in a monitored voltage signal, voltage value, or voltage level occurring at a voltage terminal of the ignition device for the stop switch. Thus, a reliable detection of the switching state, particularly the closed state, of the stop switch is achieved, particularly independently of the employed contact material of the stop switch and/or its switch construction.

If no spark discharge were to occur, e.g., during rotational speed limitation or a clocking out in which ignition occurs according to a specific rotational speed pattern and not during each magnetic generator rotation or magnet wheel rotation, therefore instead of the sampling within the ignition spark the sampling result determined during the charging coil signal is used for the switch state.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
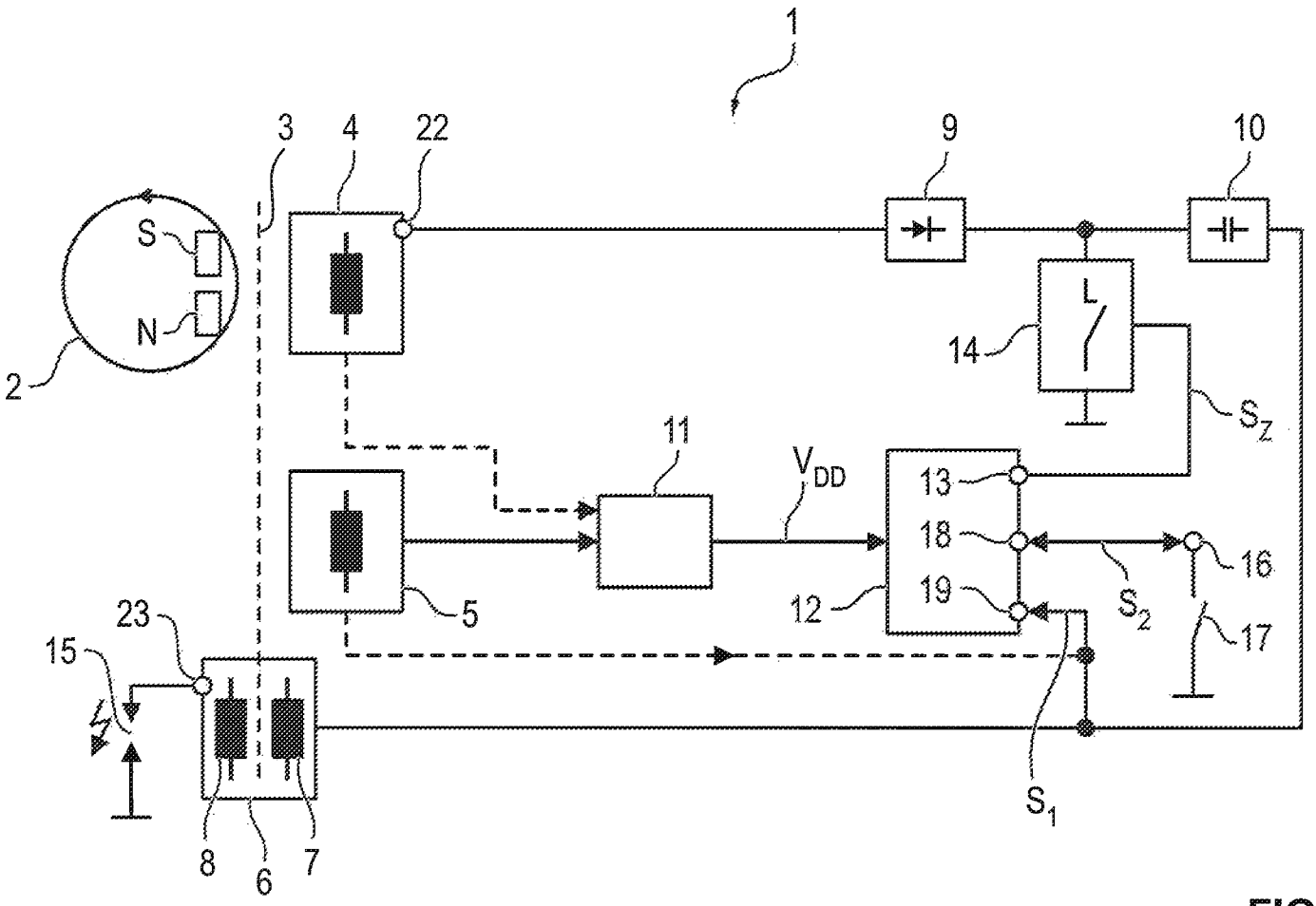
FIG. 1 shows schematically a magnetic ignition device for an internal combustion engine, for example, of a hand-held device or tool powered by a combustion engine.

FIG. 1 shows in a block diagram an ignition device (magnetic or capacitor ignition device) 1 with a magnetic generator 2 in the form of a magnet wheel which has a magnet with a north and south pole N, S and which rotates synchronously with a combustion engine not shown in greater detail. In this case, the magnetic field, generated by magnetic generator 2, amplified by an iron core 3, induces a voltage or a current in a charging coil 4 and optionally in another coil winding or trigger coil 5 and in an ignition transformer 6, often also called an ignition generator or ignition coil, with a primary winding 7 and a secondary winding 8. The positive half waves of a charging voltage (charging current) of charging coil 4 are fed via a rectifier (diode) 9 to a first power storage device 10, called an ignition capacitor hereinafter. The positive half waves of the charging voltage charge ignition capacitor 10 via primary winding (primary coil) 7 of ignition transformer 6, said winding connected in series with the capacitor, for example, to ground.

A voltage supply (power supply) 11 for a control unit and/or regulating unit 12 preferably in the form of a microprocessor or microcontroller is supplied with power via charging coil 4, according to the signal line shown as a dashed line in FIG. 1, or optionally via trigger coil 5. Voltage source 11 provides the supply voltage $V_{DD}$ for control unit and/or regulating unit 12, called a control unit hereinafter.

Unit 12 has a control output 13, which feeds an ignition pulse $S_Z$ to a control terminal (base, gate) of an electronic semiconductor switch (ignition switch) 14, for example, a thyristor, in order to control it and to discharge ignition capacitor 10 via primary winding 7 of ignition transformer 6 and to generate a high voltage pulse in secondary coil 8 of ignition transformer 6. This causes a sparkover for its part at a spark plug 15 of the combustion engine.

Ignition device 1 is moreover provided with a stop switch terminal (stop terminal) 16 or has such a terminal. A stop switch 17 is or can be connected to stop terminal 16. Stop terminal 16 is assigned a terminal (input/output) 18 of control unit 12. In particular, control unit 12 is connected via said terminal (terminal pin) 18 to stop terminal 16 in terms of circuitry and/or signals.

Control unit 12 moreover has a terminal (signal or synchronization input) 19. A voltage signal or synchronization signal $S_1$ is fed to this terminal; the signal is tapped between ignition capacitor 10 and primary winding 7 of ignition transformer 6 or at the optionally present trigger coil 5.

A voltage signal $S_2$ present at switch terminal 16 in the form of appropriate voltage values or voltage levels is supplied to terminal 18, also called a comparator input or comparator terminal pin hereinafter. A second power storage device 21, particularly in the form of a capacitor, connected to switch terminal 16 and preferably to ground, is also charged via said terminal 18 and particularly via a serial resistor 20 (FIG. 2).

Figure 2:
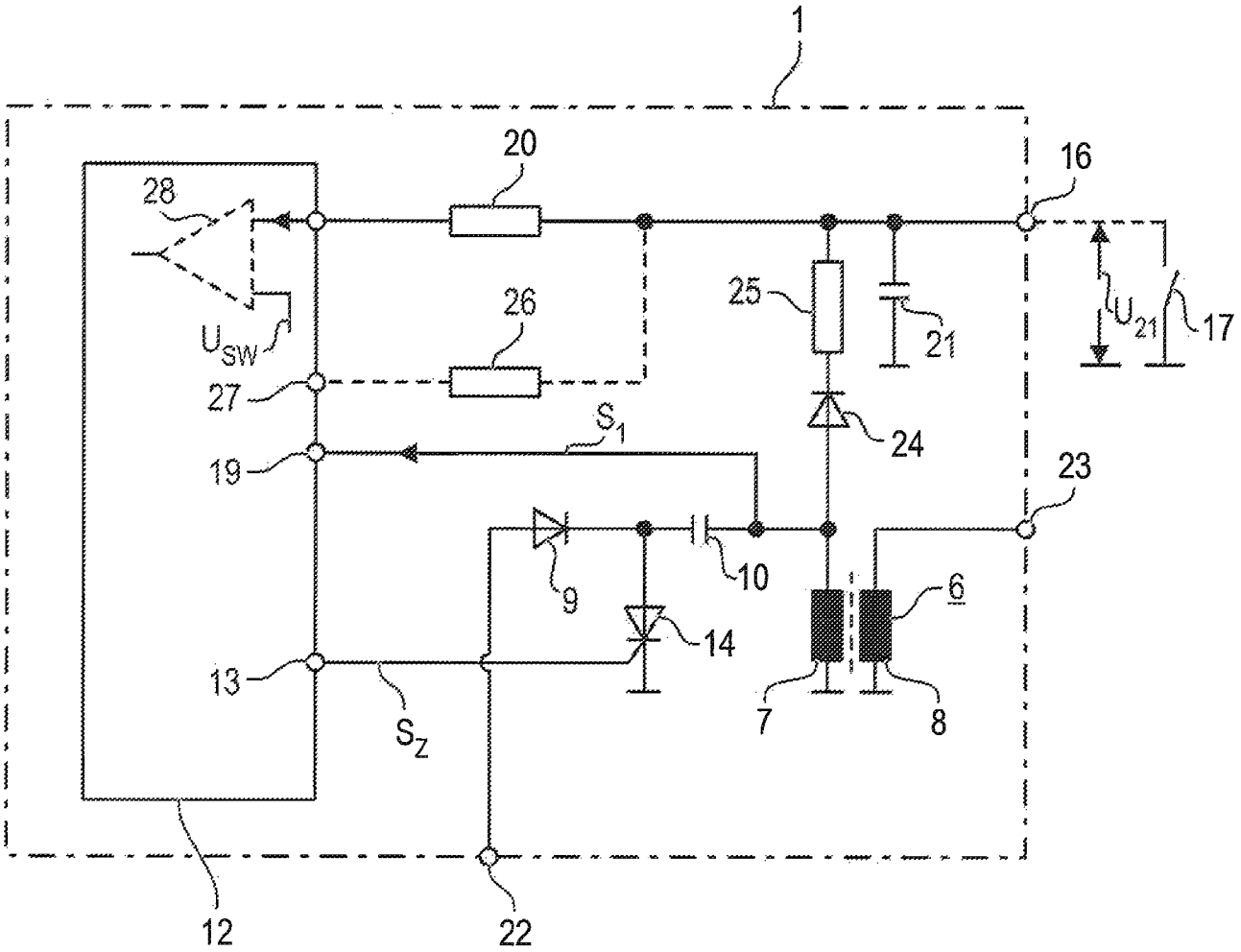
FIG. 2 shows schematically as a detail the circuitry structure of the ignition device with a control unit with a switch terminal and signal terminal connected thereto.

FIG. 2 shows a circuit component of ignition device 1 with control unit 12 which is configured as a microprocessor and has ignition switch 14, ignition transformer 6, and ignition capacitor 10. Said component is run via rectifier (diode) 9 to a terminal 22, which for its part is run to charging coil 4. On the secondary side, ignition transformer 6 is run to a terminal 23 of ignition device 1, to which, for example, spark plug 15 is or can be connected. The second power storage device in the form of capacitor 21, which is connected to ground, is assigned to switch terminal 16.

On the primary side, ignition transformer 6, i.e., its primary winding 7, is run via a series connection with a serial diode (rectifier) 24 and an ohmic resistor 25, downstream from it, to switch terminal 16 or to its connection to terminal pin 18 of control unit 12. The positive voltage half waves $S_{(+)}$ of voltage signal $S_1$ are fed via diode or rectifier 24 to switch terminal 16 and therefore also to capacitor 21. The charging of capacitor 21 occurs via terminal 18 and the downstream resistor 20 and/or via a charging resistor 26, which is connected to a terminal (charging terminal) 27 of control unit 12.

Voltage signal $S_1$ is supplied to unit 12 as a synchronization signal via synchronization terminal 19. Unit 12 has a comparator function 28 which is indicated by the dashed lines and can be configured in terms of programs, circuitry, and/or components. Said function 28, also designated as a comparator hereinafter, monitors signal $S_2$ and at specific times samples the state of charge of capacitor 21 or the voltage value or level $U_{21}$ thereof and compares this current voltage value $U_{21}$, also present at switch terminal 16, with a threshold value $U_{SW}$.

Comparator function 28 is activated only during a specific time interval. In other words, a sampling of voltage value $U_{21}$ of signal $S_2$ or a sampling of its level occurs only synchronously with a specific timeframe or at a specific time of voltage signal $S_1$. Said timeframe or said time interval or said time is suitably the first positive half wave $S_{(+)}$ or lies within said half wave $S_{(+)}$ of signal $S_1$ shown in FIG. 3.

Figure 3:
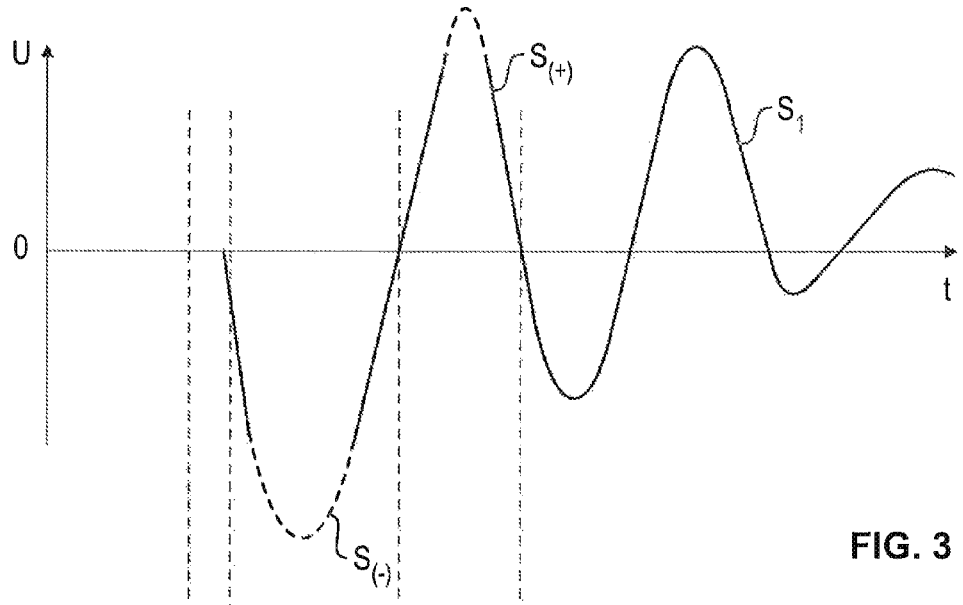
FIG. 3 shows in a voltage-time diagram the curve of a voltage or synchronization signal after triggering of an electronic ignition switch.

FIG. 3 shows this voltage signal $S_1$, which arises during ignition pulse $S_Z$ or when the ignition spark is turned on and is used for synchronizing the sampling of voltage value $U_{21}$ at switch terminal 16 and is accordingly sampled and evaluated in control unit 12.

Figure 4:
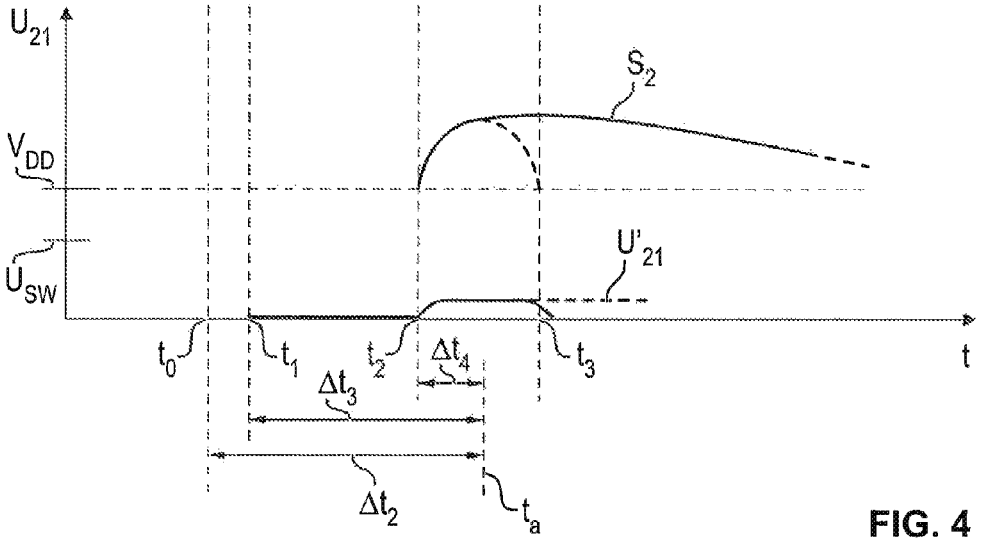
FIG. 4 shows the voltage level at the switch terminal of the ignition device or its control unit for a stop switch.

FIG. 4 shows the voltage level $U_{21}$, changing with time t, of signal $S_2$ at switch terminal 16. During the sampling of this voltage level $U_{21}$ at switch terminal 16, the second power storage device (capacitor) 21, connected to switch terminal 16, is already charged with, e.g., $V_{DD}$=5V, to a voltage value $U_{21}=V_{DD}$. In this regard, the charging voltage and thereby voltage level $U_{21}$ at switch terminal 16 is set to a specific voltage value, which preferably corresponds to the supply voltage $V_{DD}$. Capacitor 21 is precharged to this value $V_{DD}$.

It is assumed that at time $t_0$ of ignition pulse $S_Z$ for controlling ignition switch 14 is or has been generated by control unit 12. The discharge of ignition capacitor 10 via primary winding 7 of ignition transformer 6 begins at time $t_1$. As a result, ignition capacitor 10 is periodically charged and discharged, so that between ignition capacitor 10 and primary winding 7 of ignition transformer 6 the voltage signal $S_1$ appears with respect to the amplitude of negative voltage half waves $S_{(-)}$ and positive voltage half waves $S_{(+)}$ fading over time t.

Whereas the pulse inherent in voltage signal $S_1$, specifically the first negative half wave $S_{(-)}$, following the time $t_1$, with the largest amplitude is used as the primary pulse for generating the high-voltage on the secondary side of ignition transformer 6 and therefore again for generating the ignition spark, the first positive half wave $S_{(+)}$ with a relatively highest positive voltage amplitude over time starting at time $t_2$ and ending at time $t_3$ and within time interval $t_3-t_2=\Delta t$ at switch terminal 16 and with a connected stop switch 17 is connected via the stop switch to ground.

If stop switch 17 is in closed position, then a high current flow, generated following the first positive half wave $S_{(+)}$ of voltage signal $S_1$, is used to clean the possibly oxidized or contaminated contacts of stop switch 17. Because capacitor 21 is precharged to the voltage value $V_{DD}$ particularly already before this time interval $\Delta t=t_3-t_2$ of the positive half wave $S_{(+)}$, an additional charging voltage $U_{21}>V_{DD}$ is present at time $t_a$ within this time interval $\Delta t=t_3-t_2$ and therefore additional power is available at switch terminal 16. In other words, during the generation of the ignition spark and particularly during the time interval $\Delta t=t_3-t_2$ a higher current flow is available than only with the positive half wave $S_{(+)}$ of voltage signal $S_1$ and than only with voltage value $U_{21}=V_{DD}$, in order to clean reliably the contacts of stop switch 17 in its closed position and to achieve a reliable contacting in the closed position of stop switch 17.

As is illustrated in FIG. 4, the positive half wave $S_{(+)}$ of voltage signal $S_1$ at switch terminal 16 can produce a level or voltage value $U_{21}$ increased up to 6-fold compared with the voltage value (level) $U_{21}=V_{DD}$, when stop switch 17 is opened. The voltage value $U_{21}$ also increased beyond time $t_3$ can be attributed to the presence of second capacitor 21. Without this capacitor 21, the signal $S_2$ within the time interval $\Delta t=t_3-t_2$ would follow the curve indicated by dashed lines.

If stop switch 17 is in the closed position, then following the current flow across stop switch 17 during the time interval $\Delta t=t_3-t_2$, a shunt with a correspondingly low voltage level or value $U_{21}'$ is to be expected, as long as the switch contacts of stop switch 17 are beset with contaminations. This is illustrated in the bottom diagram in FIG. 4. Whereas before $t_2$ capacitor 21 is already charged or precharged by means of control unit 12, control unit 12 turns off preferably after $t_3$, therefore after the spark generation, the function of the additional charging of capacitor 21 by means of signal $S_1$ beyond the value $U_{21}=V_{DD}$ for reasons of energy efficiency or power saving.

Moreover, with use of the voltage value $U_{21}$ a closed position of stop switch 17 can be reliably inferred, i.e., that its contacts are in fact contacted and cleaned, when the voltage level or value $U_{21}$ at switch terminal 16 is below the threshold value $U_{SW}$. This is smaller than the voltage value $U_{21}=V_{DD}$ and is suitably between 2V and 4V, for example, $U_{21}$=3.5V. In other words, it can be assumed from this that in the closed state of stop switch 17 with cleaned and contacted switch contacts, a shunt is negligible and the voltage level $U_{21}$ is smaller than this threshold value $U_{SW}$ and thereby is zero or close to zero. If the voltage level or value $U_{21}$ at switch terminal 16 is greater than or the same as threshold value $U_{SW}$, therefore it can be assumed that stop switch 17 is opened.

The sampling of the voltage level $U_{21}$ at switch terminal 16 by means of comparator function 28 of control unit 12 proceeds synchronously with that of voltage signal $S_1$ and thereby during the first positive half wave $S_{(+)}$. An especially suitable sampling time $t_a$ (FIG. 4) is in terms of time within the time interval $\Delta t$ between the times $t_2$ and $t_3$ of the first positive half wave $S_{(+)}$ after a voltage drop or voltage breakdown has occurred, whereas a corresponding current is provided via charging coil 4 in addition across closed stop switch 17.

In an advantageous refinement of the invention, therefore a timing element $\Delta t_n$ is started for or during the synchronization. The starting time of said timing element $\Delta t_n$ can be the time $t_0$ for generating ignition pulse $S_Z$ or the ignition time. The corresponding timing element $\Delta t_2$ then runs down to time $t_a$, at which time $t_a$ the sampling of the current voltage level $U_{21}$ at switch terminal 16, therefore the stop sampling occurs. An open or closed stop switch 17 can be inferred from the voltage value $U_{21}$ or $U_{21}'$ at switch terminal 16.

An alternative timing member $\Delta t_3$ is started at time $t_1$, at which the first negative half wave $S_{(-)}$ of voltage signal $S_1$ and therefore the generation of the ignition pulse $S_Z$ or of the ignition spark begin. This time interval $\Delta t_a$ again ends between the times $t_2$ and $t_3$ of the first positive half wave $S_{(+)}$ of voltage signal $S_1$, preferably at time $t_a$. A further suitable timing member is the time interval $\Delta t_4$ which begins at time $t_2$ and again ends at time $t_a$.

The synchronization of the comparator or the comparator function 28 with the voltage signal $S_1$ therefore occurs preferably during the first positive half wave $S_{(+)}$and/or by means of a timer with use of one of the time intervals $\Delta t_n$. The sampling time $t_a$ is thereby in terms of time preferably sufficiently distant from time $t_2$. The sampling time $t_a \geq t_2+\Delta t/2$ is especially preferred.

Figure 5:
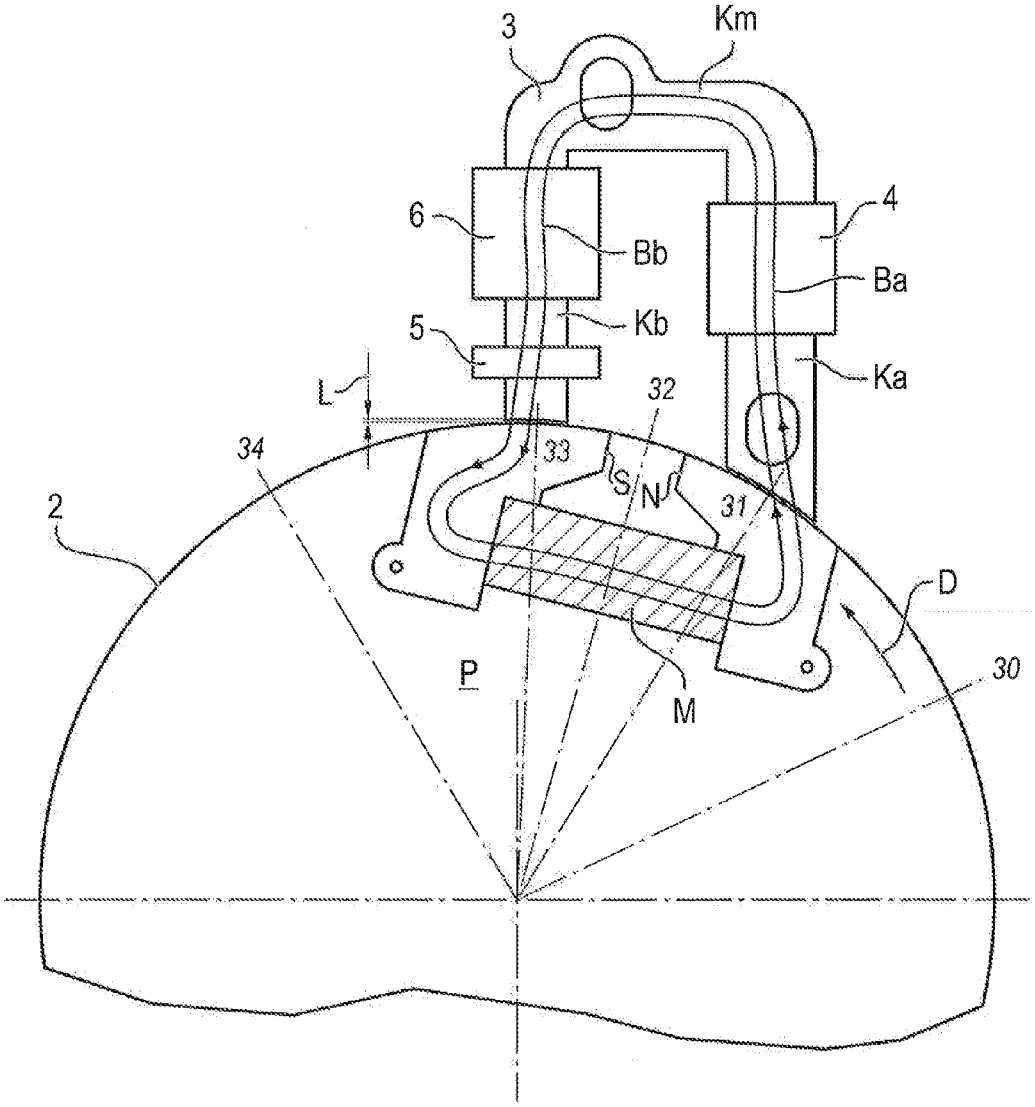
FIG. 5 shows schematically the magnetic generator of the ignition device including a magnet wheel with magnets and an iron core and coils arranged thereon.

FIG. 5 shows the functionality of magnetic generator 2 of ignition device 1 according to the generator or dynamo principle. A permanent magnet M with a north pole N and a south pole S is arranged on the magnet wheel P in an exposed circular segment. The preferably U-shaped iron core 3 with two iron core legs Ka and Kb and with a connecting or middle leg Km is arranged opposite to magnet wheel P. Iron core 3 supports charging coil 4 or ignition transformer 6 and optionally trigger coil 5 on its legs Ka and Kb.

Figures 6A, 6B, 6C, 6D:
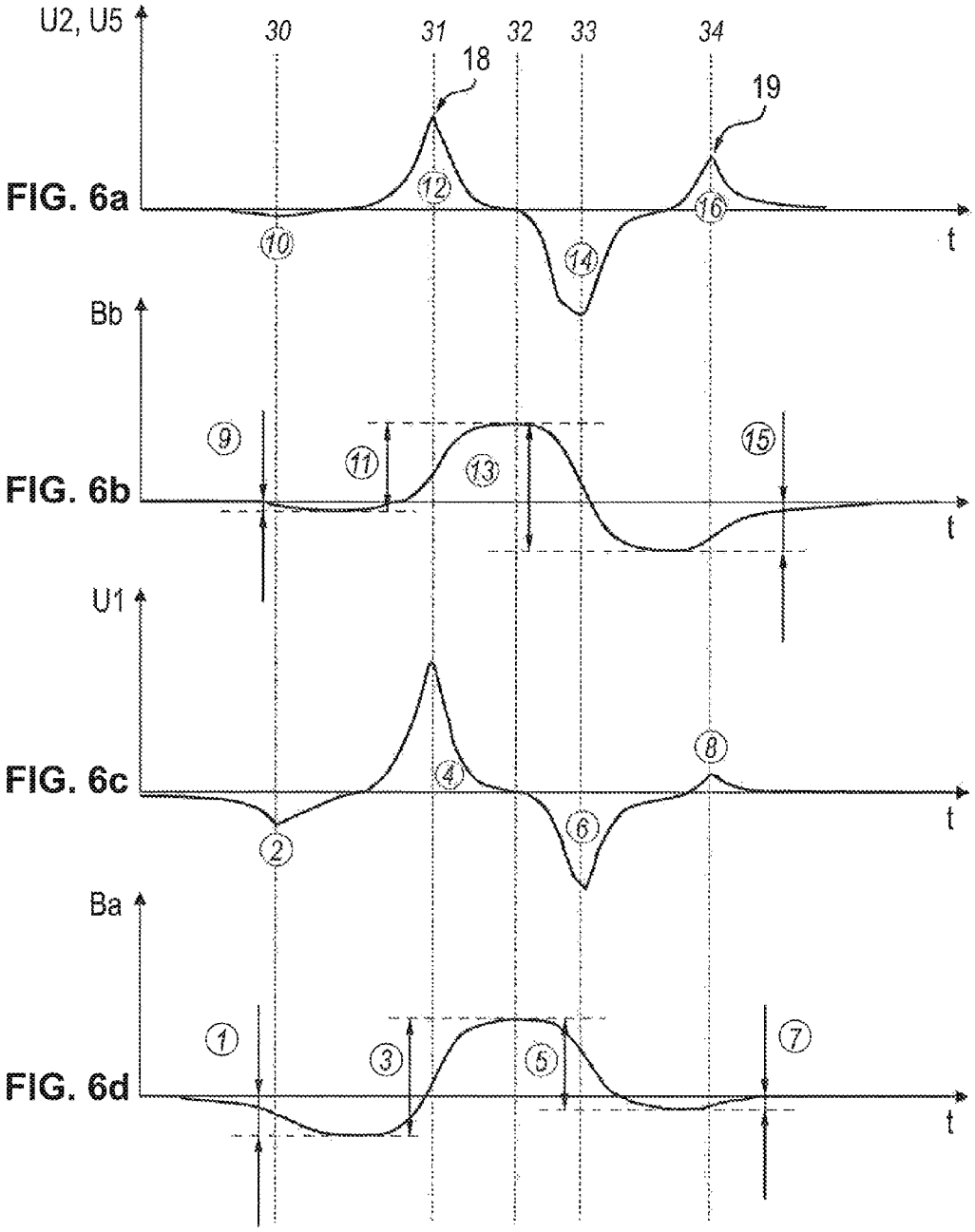
FIG. 6 shows time-dependent curves of the charge voltage of the charging coil (FIG. 6*c*) and other coils or windings (FIG. 6*a*) and of magnetic fluxes (FIGS. 6*b* and 6*d*) in the legs of the iron core according to FIG. 2.

Magnet wheel P rotates synchronously with a crankshaft of the combustion engine or internal combustion engine. Magnet wheel P rotates, for example, in a counterclockwise rotation direction D. The particular magnetic flux Ba or Bb periodically flows via an air gap L through iron core 3 or its legs Ka, Kb with each rotation of the magnet wheel P. As a result, a charging coil signal $U_{LS}$, also called a charging voltage hereinafter, whose time curve is shown in FIG. 6*c*, is induced in charging coil 4. FIG. 6*a* shows the temporal voltage curve in ignition transformer 6 and in trigger coil 5. The field profiles in legs Ka and Kb are shown in FIG. 6*d* or 6*b*.

Figure 7:
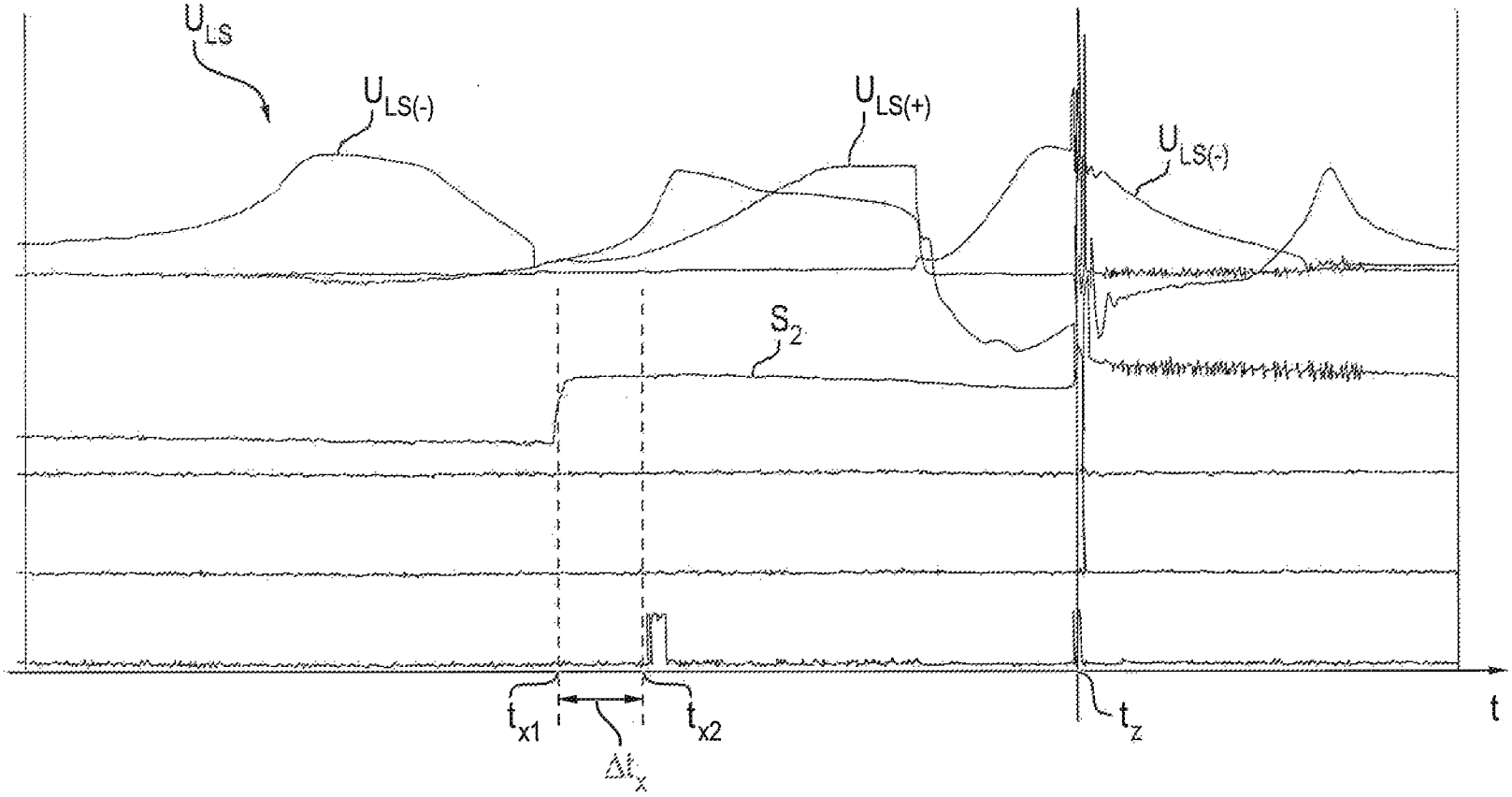
FIG. 7 shows the time curve of the charging voltage and a primary coil voltage, as well as a voltage at a signal terminal (stop port) of the control unit in the form of preferably a microcontroller (μC).

FIG. 7 shows the time course of the charging voltage $U_{LS}$ with inverted negative half waves $U_{LS(-)}$. Moreover, FIG. 7 shows voltage signal $S_2$ at switch terminal 16, which is supplied via terminal pin 18 to control unit 12.

As is evident in FIG. 7, a sampling or scanning of signal $S_2$ at switch terminal 16 begins at time $t_{x1}$ and ends, for example, at time $t_{x2}$. This so-called low-voltage sampling occurs before the ignition time $t_z$, but during the same rotation of magnet wheel P and therefore during the same rotation of magnetic generator 2. The signal $S_2$ represents the time curve of the charging voltage or of the voltage value $U_{21}$ at capacitor (parallel capacitor) 21 (FIG. 2). This signal $S_2$ at stop terminal or switch terminal 16 is sampled repeatedly. If a voltage value $U_{21}$ (low level) is detected repeatedly that is smaller than $U_{21}=V_{DD}$, thus this is an indication for actuating stop switch 17 in its closed position.

Moreover, the sampling or scanning of the signal level or value $U_{21}$ at switch terminal 16 within or during the first positive half wave of the charging voltage $U_{LS}$ occurs in accordance with the voltage half wave 4 in FIG. 6*c*. If a low level at switch terminal 16 is detected less often, thus no closing of stop switch 17, and accordingly no stop command, is detected. This low-voltage sampling occurs suitably in addition to and thereby before the sampling of the actuation state of stop switch 17 at ignition time $t_z$, but during the same rotation of magnetic generator 2.

The invention is not limited to the exemplary embodiments described above. Rather, other variants of the invention can also be derived herefrom by the person skilled in the art, without going beyond the subject matter of the invention. Particularly, further all individual features described in relation to the exemplary embodiments can also be combined with one another in a different manner, without going beyond the subject matter of the invention.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A method for detecting an opened or closed switching state of a stop switch at a switch terminal of an ignition device for an internal combustion engine, the method comprising:

providing a control unit;

providing an electronic ignition switch;

providing the stop switch;

generating an ignition pulse for controlling the electronic ignition switch, the ignition pulse being supplied from the control unit to the electronic ignition switch;

discharging a first power storage device via an ignition coil and during this discharge a first voltage signal having negative and positive voltage half waves is generated and supplied to the control unit; and using the generated first voltage signal for synchronizing a sampling, representing a switch state of the stop switch, of a voltage value at the switch terminal, the voltage value being supplied to the control unit by a second voltage signal, the second voltage signal supplied from the switch terminal of the stop switch, wherein the first voltage signal is separate and independent from the second voltage signal supplied from the switch terminal of the stop switch.

2. The method according to claim 1, further comprising:

precharging a second power storage device connected to the switch terminal to a first voltage value;

charging the second power storage device connected to the switch terminal via at least one positive voltage half wave of the first voltage signal to another voltage value that is higher compared with the first voltage value when the stop switch is in the open position; and sampling the voltage value at the second power storage device and/or at switch terminal.

3. The method according to claim 2, wherein a temporal voltage curve of the first voltage signal is used for synchronizing the sampling at the second power storage device or at the switch terminal.

4. The method according to claim 1, wherein a first positive voltage half wave of the first voltage signal is used for synchronizing the sampling of the voltage value at a sampling time during the first positive voltage half wave of the first voltage signal.

5. The method according to claim 1, wherein the switching state of the stop switch is inferred from a deviation of the current voltage value from a threshold value, wherein a closed position of the switching state is detected when the voltage value is smaller than the threshold value, and wherein an open position of the switching state is detected when the voltage value is greater than or equal to the threshold value.

6. The method according to claim 1, wherein a closed state of the stop switch is inferred, when the voltage value at the switch terminal during a first positive half wave of the first voltage signal and after the expiration of a timing member falls below a threshold value, and wherein the timing member is started at time of the generation of the ignition pulse or at the ignition time or at a time between the time of the generation of the ignition pulse and a temporal occurrence of a characteristic voltage value of the first voltage signal.

7. The method according to claim 1, wherein at least positive voltage half waves of the first voltage signal, arising during the discharge of the power storage device, are supplied to the switch terminal.

8. The method according to claim 1, wherein, depending on a rotary position of a magnetic generator coupled to the internal combustion engine, a charging coil signal with alternating negative and positive voltage half waves is generated, and wherein the charging coil signal is used for charging the first power storage device.

9. The method according to claim 8, wherein, during a positive voltage half wave or during a first positive voltage half wave of the charging coil signal and before the generation of the ignition pulse the voltage value is sampled at the switch terminal of the ignition device to detect the switching state of the stop switch, and wherein the closed or open position of the stop switch is inferred from a deviation of the sampled voltage value from a first voltage value and/or a threshold value.

10. The method according to claim 1, wherein the switch state is a closed position.

11. The method according to claim 1, wherein the stop switch is a separate switch from the electronic ignition switch.

12. An ignition device for an internal combustion engine, comprising:

a magnetic generator coupled to the internal combustion engine;

a charging coil, which, depending on a rotary position of the magnetic generator, generates a charging coil signal with alternating negative and positive voltage half waves;

a stop switch;

a switch terminal for the stop switch;

an electronic ignition switch; and a control unit, wherein the control unit generates an ignition pulse for switching through the electronic ignition switch to discharge a power storage device via a primary winding of an ignition transformer, wherein the control unit has a synchronization input, to which a first voltage signal, arising during the discharge of the power storage device, is supplied, wherein the control unit has a comparator input, to which a second voltage signal and a voltage value, arising during an actuation of the stop switch at the switch terminal, is supplied from the switch terminal of the stop switch, wherein the control unit has a comparator function, which compares a voltage value at the switch terminal and/or at a second power storage device with a threshold value, a comparison result providing an opened or closed switch state of the stop switch, and wherein the first voltage signal is separate and independent from the second voltage signal supplied from the switch terminal of the stop switch.

13. The ignition device according to claim 12, wherein the control unit with or after the generation of the ignition pulse, depending on a course of the primary side of the ignition transformer or a voltage signal tapped at a trigger coil, starts a timing member, and wherein after expiration of the timing member, a sampling of the current voltage value occurs at the switch terminal or at the second power storage device.

14. The ignition device according to claim 12, wherein the control unit with the occurrence or at a specific time of a first positive voltage half wave of the charging coil signal starts a timing member, during which a sampling or a sampling sequence with a number of scans, of the current voltage value occurs at the switch terminal or at the second power storage device.

15. The ignition device according to claim 12, wherein the stop switch is a separate switch from the electronic ignition switch.

* * * * *